US007722012B2

(12) United States Patent
Kirker et al.

(10) Patent No.: US 7,722,012 B2
(45) Date of Patent: May 25, 2010

(54) TAIL SECTION FOR CARPET STRETCHING TOOL

(75) Inventors: William Kirker, Apple Creek, OH (US); Tan D. Nguyen, Milpitas, CA (US)

(73) Assignee: Crain Cutter Company, Inc., Milpitas, CA (US)

( * ) Notice: Subject to any disclaimer, the term of this patent is extended or adjusted under 35 U.S.C. 154(b) by 0 days.

(21) Appl. No.: 12/030,727

(22) Filed: Feb. 13, 2008

(65) Prior Publication Data

US 2008/0217593 A1 Sep. 11, 2008

Related U.S. Application Data

(62) Division of application No. 11/684,429, filed on Mar. 9, 2007, now Pat. No. 7,451,961.

(51) Int. Cl.
*B65H 77/00* (2006.01)

(52) U.S. Cl. ..... 254/212; 254/209; 294/8.6

(58) Field of Classification Search ..... 254/200, 254/209, 212; 294/8.6

See application file for complete search history.

(56) References Cited

U.S. PATENT DOCUMENTS 58,831 A 10/1866 Hungerford
3,441,252 A 4/1969 Koppelmans
3,706,440 A 12/1972 Ross
3,747,157 A 7/1973 Szymanski
3,752,440 A 8/1973 Ream
4,538,846 A 9/1985 Alexander
4,934,658 A 6/1990 Berg et al.
5,176,387 A 1/1993 Taggart
5,681,031 A * 10/1997 Foley ..... 254/209
5,855,361 A 1/1999 Krowchak
D413,498 S 9/1999 Krowchak
6,491,284 B1 * 12/2002 Jolly et al. ..... 254/209

* cited by examiner

*Primary Examiner*—Emmanuel M Marcelo
(74) *Attorney, Agent, or Firm*—Schneck & Schneck; David M. Schneck

(57) ABSTRACT

A tail section for a carpet stretching tool. The carpet stretching tool is the type having a carpet engaging head, an elongate body, a tail section and a lever mechanism allowing extension of the elongate body. The tail section includes a first leg and a second leg, each leg having a wall running face. The legs may be selectively positioned between at least two positions. In one positions the wall running faces form a substantially flat surface allowing use of the tool down a wall section. In a second position the wall running faces on the first and second leg of the tool may be positioned at an angle to allow the tool to be used on corner locations within a room or on a post.

6 Claims, 10 Drawing Sheets

Fig._ 7
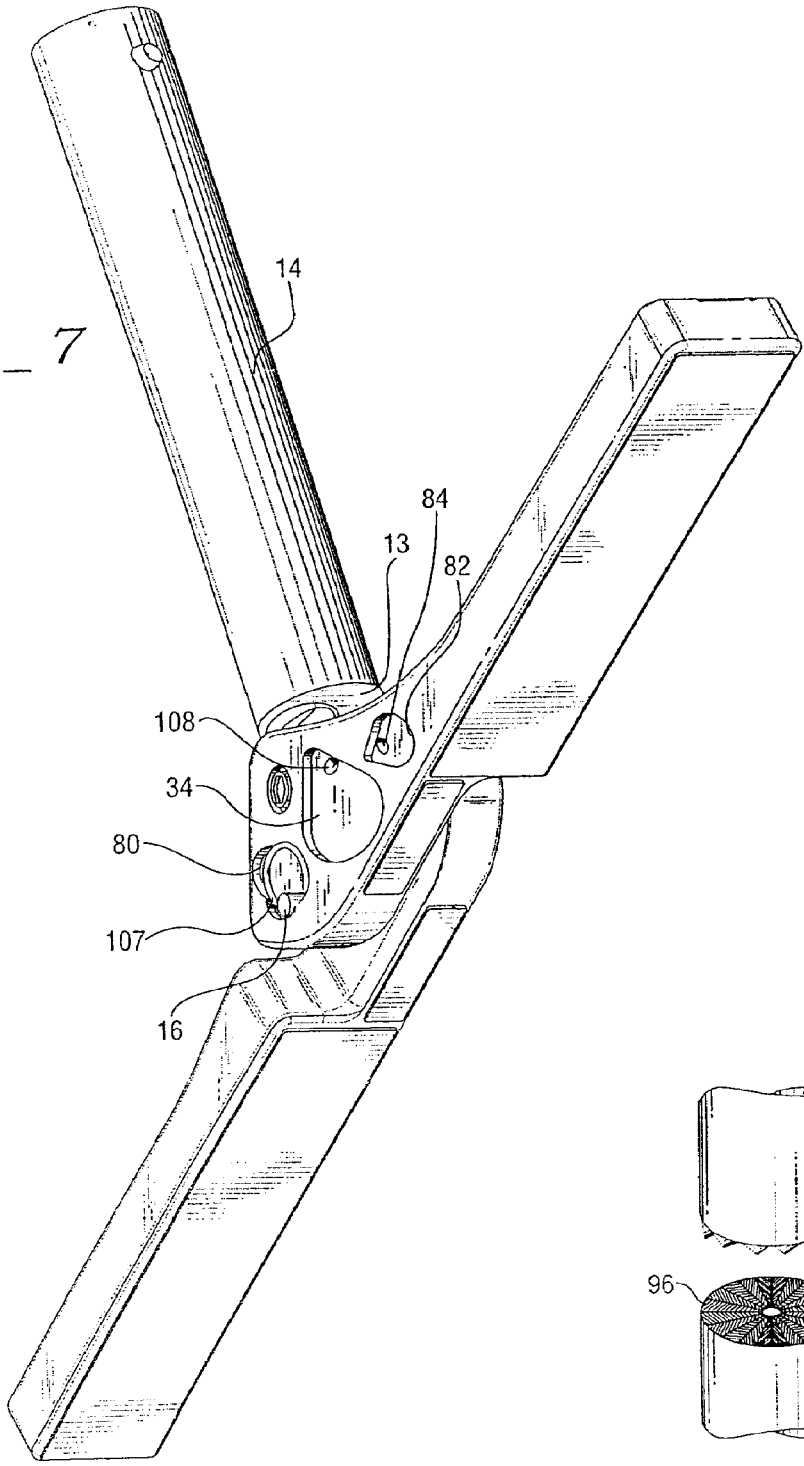
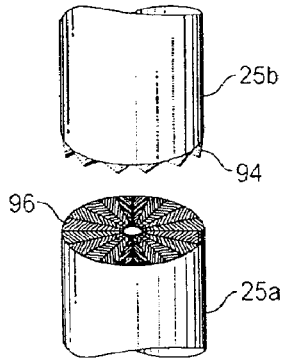
Fig._ 6

TAIL SECTION FOR CARPET STRETCHING TOOL

CROSS-REFERENCE TO RELATED APPLICATION

This is a divisional of pending U.S. patent application Ser. No. 11/684,429 filed Mar. 9, 2007.

TECHNICAL FIELD

The disclosed device relates to carpet tools and more specifically to carpet stretching tools.

BACKGROUND

Installing wall-to-wall carpeting generally requires the installation of carpet retaining wood strips (also called "tackless strips" or "tack strips"). These tack strips are nailed into the flooring adjacent to walls in a room to be carpeted. One edge of the carpet is then secured to tacks extending from the strip. The carpet is then stretched so that the opposite edge can be secured to the tack strip on the other side of the room. This method of installation helps to ensure that the carpet will not buckle or form bumps.

A carpet stretching tool is used to stretch the carpet between the tack strips. FIG. 1 illustrates a typical conventional carpet stretching tool, such as the Power Stretcher tool sold by Crain Tools. The illustrated carpet stretching tool includes a carpet gripping head 62 having carpet engaging pins 66. Adjusting knob 68 on head 62 allows adjustment of pin depth, allowing for gripping at various depths of shag carpet or carpet piles. Carpet engaging head 62 is mounted on square bar 74, which is slidably mounted within tube 72. At the end of tube 72 is mounted tail section 8. Tail section 8 may be mounted using a tail tube section 14 mounted onto the main tube 72 by a spring clip inserted at the open end of tube 14, the buttons 19 of said spring clip extending through holes 30 in main tube 72. Extending from tube 72 are transfer bars 70. Transfer bars 70 are mounted at a pivot point on both ends of transfer bar 70 to both the tube 72 and handle 60, respectively. At the end of handle 60 is grip 64. The tail section 8 has a flat surface that presses against the wall where the carpet is already secured. The pins 66 on carpet gripping head 62 then grip the carpet proximate to the edge of the carpet opposite the tail. Handle 60 is then depressed, causing gripping head 62 to extend away from tube 72. This extends head 62 from tail section 8, thereby stretching the carpet. The carpet is stretched to the location of the tack strips on the second side of the room. Once the carpet is secured, the tail section may be rolled along the wall using wheels 7. The tool may be rolled after pins 66 have been disengaged from the carpet.

In the process of using this carpet stretching tool, the installer begins at one corner of the room, placing the tail against a first wall proximate to a corner and extending the elongate body of the tool such that the carpet gripping head grips the carpet near the edge on the opposite side of the room. The tool is then used to produce leverage, thereby stretching the carpet. The edge of the carpet proximate to the head is attached to the tack strip. The head is then disengaged from the carpet and the tail end is slid or rolled a distance down the floor against the first wall. Rollers on the tail may aid in moving the tool down a wall. This process is then repeated.

The tail section 8 of a conventional carpet stretching tool, shown in FIG. 1, has a generally flat surface on its back side where it presses against a wall. It works well against straight, flat wall surfaces and when the carpet to be stretched is more or less straight across the room from the current position of tail section 8. However, some carpet installations are performed in "L" shaped living room/dining room areas, which are common in modern "open floor plan" home layouts. In such "L" shaped living room/dining rooms, the installer will desire to brace the tail section off an inner wall until reaching an outside corner. The reason an inner wall is preferred is that on the outer wall, doors (such as sliding glass doors), are often encountered. Such doors are not suitable to support tail section 8. Once the outside corner is reached, the installer must angle head 62 and elongate tube sections to reach further across the room and into the opposite corner of the room. However, the more that head 62 and elongate tube sections are angled, the more a horizontal force transfers to the back surface of tail section 8. Eventually, the tail section 8 will slip horizontally and will no longer function. The installer must a) have a helper keep a foot on the tail block to stop it from slipping or b) get more extension tubes and press the tail section against a different wall. Neither option is convenient and both add costs to installation. If tail section 8 could somehow be braced against the outside corner in such a manner that prevents slipping, the installer could continue stretching in a fan-like pattern all the way into the corner of the opposite wall and beyond out of the corner until the elongate tubes extending from head 62 were again more or less perpendicular to the opposite wall surface (at which point the flat surface of tail section 8 would no longer slip). While the stretcher would be used in this "fan pattern," it is desirable that the back surface of tail section 8 stay in the corner, but the elongate tube section would need to pivot from this fixed position to accomplish the desired fanning motion for the head 62.

Also, in homes having basements, there is typically a support post in the center of these basements. The post is sturdy and tail section 8 could be butted up against it for stretching. However, the posts encountered in basements are commonly cylindrical. The flat back surface of tail section 8 will slip if the elongate tube section is at any angle other than a right angle to the back surface of tail section 8. In this situation, it would be desirable if the elongate tube section were fixed perpendicularly to the back surface of tail section 8, not pivoting as it normally does. It would also be desirable that tail section 8 formed some other shape so that it would not slip, as the curved surface of a round post provides little traction for a tail section 8 with an elongated flat surface.

A number of prior art devices have been developed to address the installation of carpet in various shaped rooms, and to allow carpet stretcher tail sections to be used on surfaces which are not straight, flat wall surfaces. For example, U.S. Pat. No. 3,706,440 to Ross discloses a tail section for a carpet stretcher. The tail section has a pivotably mounting adapter tube to connect with an elongate tube section. The tail section has two vertically extending surfaces for abutting a wall forming an included angle, this angle being about 90 degrees, allowing it to be used at an outside corner surface. This device also has horizontal surfaces extending from the ends of the vertical surfaces. These horizontal surfaces allow use of the tail section against straight, flat walls.

The tail section device of the Ross patent has a number of drawbacks. The included angle vertical surfaces are just used for holding the device at a corner location and the horizontal surfaces are just used on flat wall surfaces. The tail section must be relatively large to include both the specified vertical and horizontal surfaces. Such a large tail section makes the tool more expensive, heavy, and bulky. Such a bulky tail section is difficult to fit inside a carrying case. Most modern carpet stretcher tools are sold with a carrying case that holds all tool components. Furthermore, the attachment of the tail section is at the apex of the included angle. When the tail section is used on a flat surface, the central area of the tail section (between the two horizontal surfaces) creates a gap where the tail is not in contact with the wall. The force generated by the stretching components will transfer to the tail section at the apex of the included angle where the elongate tube body is attached to the tail section. When the tail section is used on a flat wall, the force will be concentrated at the inner edges of the horizontal surfaces. This concentrated force could mar wall surfaces. Finally, the Ross device has no mechanism to lock the tail section with respect to the elongate tubes. This can limit the usefulness of the carpet stretcher tool.

U.S. Pat. No. 3,747,157 to Szymanski discloses a carpet stretcher having a carpet engaging head mounted on a tubular body. At the end of this tubular body, an adapter to the stretcher is formed by two spaced parallel triangular plates. The two plates are pivotably mounted to the stretcher by way of a registering hole and a connecting pin which runs through the stretcher tube. Along two sides of the triangular plates up to two elongate tube sections may be pivotably mounted with similar register holes and connecting pins. Thus, one of the elongate tube sections may be pivoted in a direction where it abuts against a wall surface near an outside corner, and the other may be pivoted in a direction such that it abuts a second adjacent wall, thereby preventing slippage of the tail section at the outside corner. U.S. Pat. No. 3,752,440 to Ream discloses a similar adapter which uses three short, permanently-mounted pivoting adapter tubes (rather than holes and pins) to connect to the stretcher and elongate tube sections. Also disclosed are a plurality of available tail sections for engaging the wall on the end of the elongate tube sections, one of which is "L" shaped for outside corners. U.S. Pat. No. 5,176,387 to Taggart discloses yet another similar adapter with a "T" shaped bracket. One leg of the T attaches rigidly into the stretcher tube. The other two legs have pivoting mounts for adapter tubes which may be connected to the elongate tube sections. In this device, the tail sections may pivot as they abut the wall surfaces. This configuration allows this type of adapter to be used in long hallways.

Common problems with all these adapters with pivots for an additional elongate tube section are as follows. First, they are a costly additional accessory to the basic carpet stretcher. Second, the user may not own the additional elongate tube sections (such as would be required for tools having two additional legs) and have to purchase them along with an additional tail section. Third, it is inconvenient to carry these additional components on the jobsite. Lastly, such devices are not designed for stretching using posts.

U.S. Pat. No. 4,730,858 to Humann discloses an "S" shaped adapter intended to work with commonly available carpet stretcher tail sections. One end of the adapter hooks over the outside corner surface of the walls. The other corner extends from the wall and creates a stop that prevents slipping of the tail section. Again, this is a costly separate adapter which must be carried on the jobsite, and is useful only for outside corners.

U.S. Pat. No. 4,538,846 to Alexander discloses a plurality of brace assemblies which may connect to the end of an elongate tube section, and are "U" shaped to abut and fit around various diameter round and square posts. With respect to their relation to the elongate tube section they are meant to be attached to, some of the "U" shaped brace assemblies are designed to pivot, some are designed to pivot and lock at certain points, and others are designed without any ability to pivot. These devices are useful only for stretching off posts.

U.S. Pat. No. 5,855,361 to Krowchak discloses a tail section similar to the one disclosed in U.S. Pat. No. 3,706,440 to Ross. This tail section has a pivoting adapter tube. The tail section's wall-abutting surface has two vertically extending surfaces forming an included angle of 90 degrees for stretching off outside corners. Within this included angle, a hook adapter may be inserted. This hook adapter pokes through the carpet and hooks into the subfloor. The hook provides a stop for the stretcher. The elongate tube section which would normally extend to the wall is no longer needed. This tail section also includes a lock pin which extends through the adapter tube. Thus, the included angle may engage posts, and the elongate tube section may be locked as desired. All of the above references are hereby incorporated by reference herein.

The problems with this tail section are as follows: First, the 90 degree angle formed in the tail section results in a large, bulky tail component. Second, the locking pin for the elongate tube section runs directly through the pivoting tube. In most carpet stretching tools the pivoting tube is preferably made from a steel tube. The holes in a steel tube may elongate and become imprecise when subjected to side loads by the steel pin. This is because the walls of the steel tube are thin. As the holes elongate, the tail block will no longer hold the desired perpendicular angle with the elongate tube section and will rattle. Furthermore, the thin walls of the steel tube will scratch and burr the pin. Pin holes are preferably created in a softer, solid material (such as an aluminum casting). In contrast, the bearing holes for the pin are thick and precisely reamed and can thus totally support the pin.

In the Krowchak reference, the tail section itself is said to be pivotably mounted directly to the end of a tubular member by way of a similar pin. Under pressure from the elongate tube section, the pin would press against holes in the tubular member, and the holes in the tubular member would elongate. The motion of the pivoting tube would become imprecise and would bind as burs were worn in the pin by the tube.

Lastly, the tail section is not supported in the area of the 90 degree included angle. Yet this area bears most of the pressure from the elongate tube section. As a result, the tail section may leave an impression or mark on the wall at the edges of the horizontal tail section.

SUMMARY

A tail section for a carpet stretching tool including: a head that is able to grip the carpet; an elongate body; and a stretching mechanism that is able to extend the elongate body. The tail section may be mounted to the elongate body, for example using a tube and a spring clip. A pivot adapter may be joined to this tube. The tail section may include a first and second leg, each leg having a wall running face, and a pivot fastener running through a pivot hole in each of the first and second legs. This device may include protector pads mounted on each face to prevent marring wall surfaces and to make sliding along walls or retaining against walls easier. The legs are selectively positionable with respect to each other. A pin may be inserted through either of a first or second locking holes on a top face of top leg. The pin extends through the hole in the top leg and into one of a first, second, or third hole in a bottom leg. Said pin may also pass through a first hole in the pivot adapter. During normal stretching, when the tail section contacts a straight, flat wall, the overall wall running face may be flat, and the tail section be allowed to pivot. For this situation, the user puts the pin through a first hole in the top leg, and a first hole in the bottom leg, which locks the first and second wall running faces flat in relation to each other. Using this combination of holes, the tail section may pivot. At an outside corner, in some embodiments it is preferred that the overall wall running face may be approximately square (or with first and second wall running faces at 90 degrees to each other), and that the tail section still pivot. For this purpose, the user puts the pin through a first hole in the top leg, and a second hole in the bottom leg. The first and second wall running faces are locked at a 90 degree angle, but the tail section still pivots. When stretching off a post, again the wall running face may be square, but the tail section should not pivot. The user puts the pin through a second hole in the top leg, a first hole in the pivot adapter, and a third hole in the bottom leg. The first and second wall running faces are locked at a 90 degree angle, but the tail section will no longer pivot. The pin may be accessible in a recessed well on the top surface of either of the legs. A pull ring attached to the pin may be used to aid in removal of the pin. Both holes in the top leg are accessed in this recessed well.

BRIEF DESCRIPTION OF THE DRAWINGS

FIG. 6 illustrates an alternative embodiment for angle formation and locking of the top leg and bottom leg, employing ridges and valleys formed in the top and bottom faces of two metal tubes press fit into said top and bottom legs.

FIG. 7 is a back perspective view of an alternate embodiment of the tail section having three pin holes on the top leg.

DETAILED DESCRIPTION OF THE INVENTION

Figure 1:
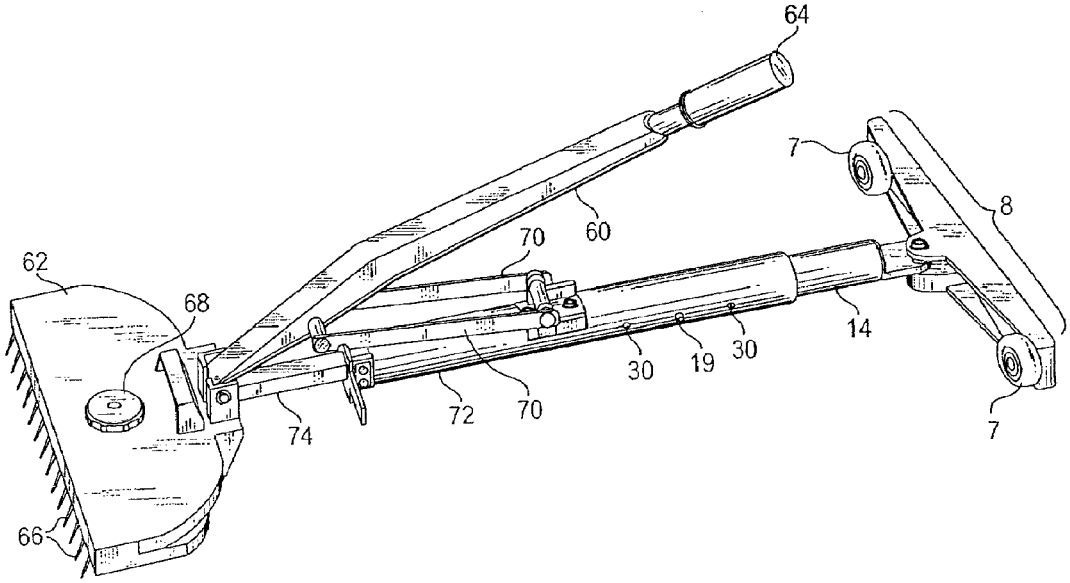
Fig. 1 (Prior Art)
FIG. 1 is a side perspective view of a prior art carpet stretcher tool.
Figure 2:
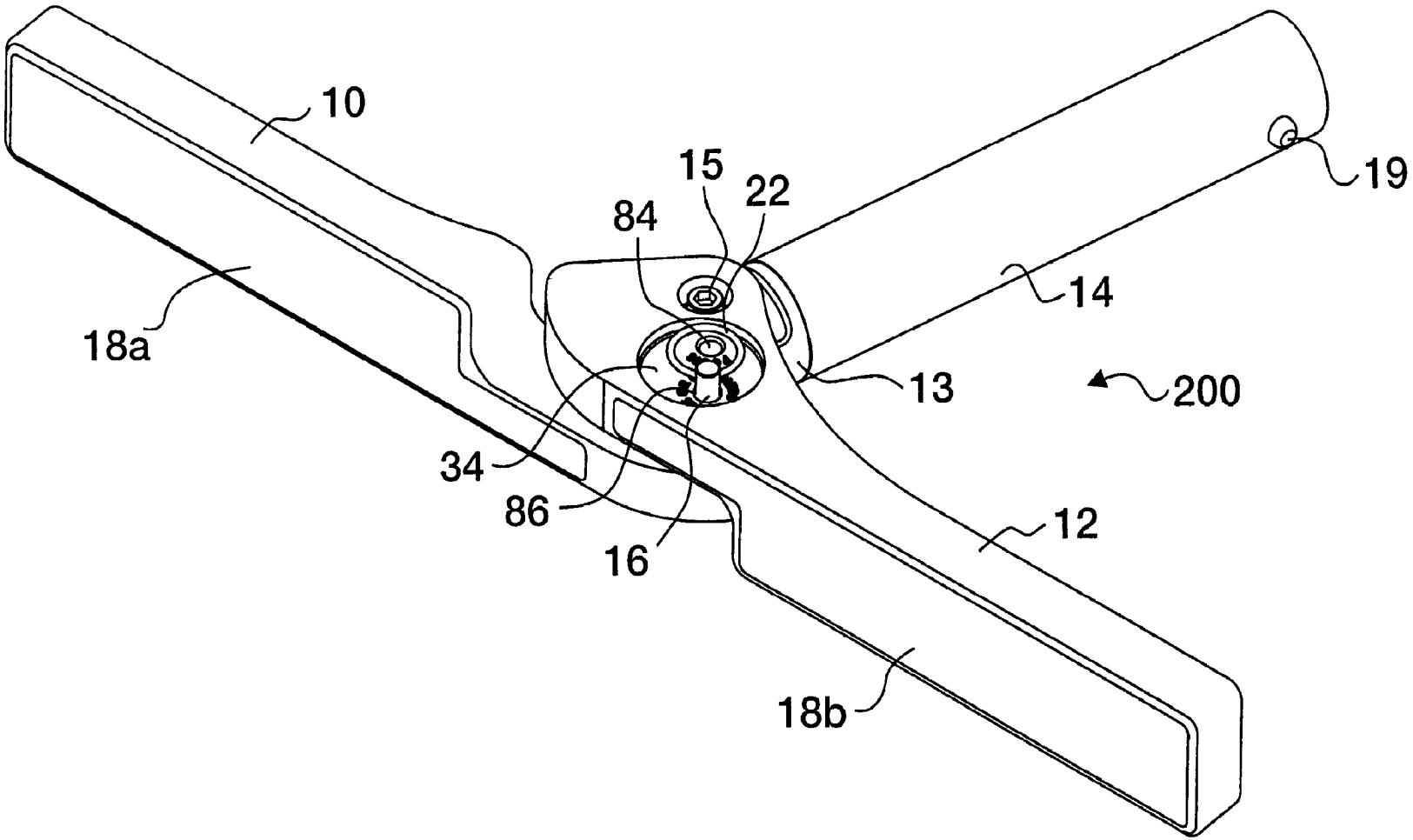
FIG. 2 is a perspective view from the back or wall running faces of the first and second leg forming the back of the tail section.
Figure 3:
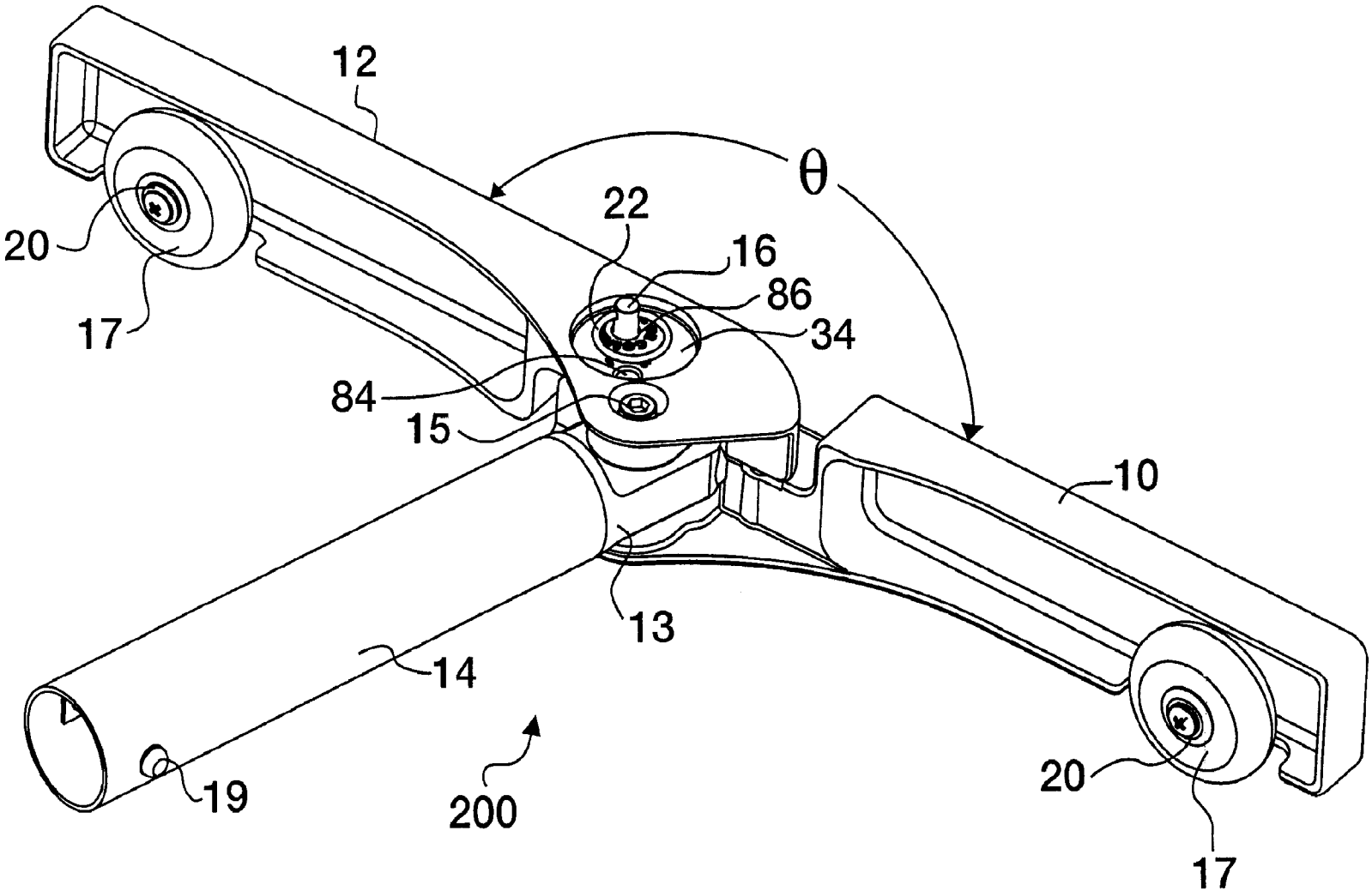
FIG. 3 is a front perspective of the tail section of FIG. 2.
Figure 5:
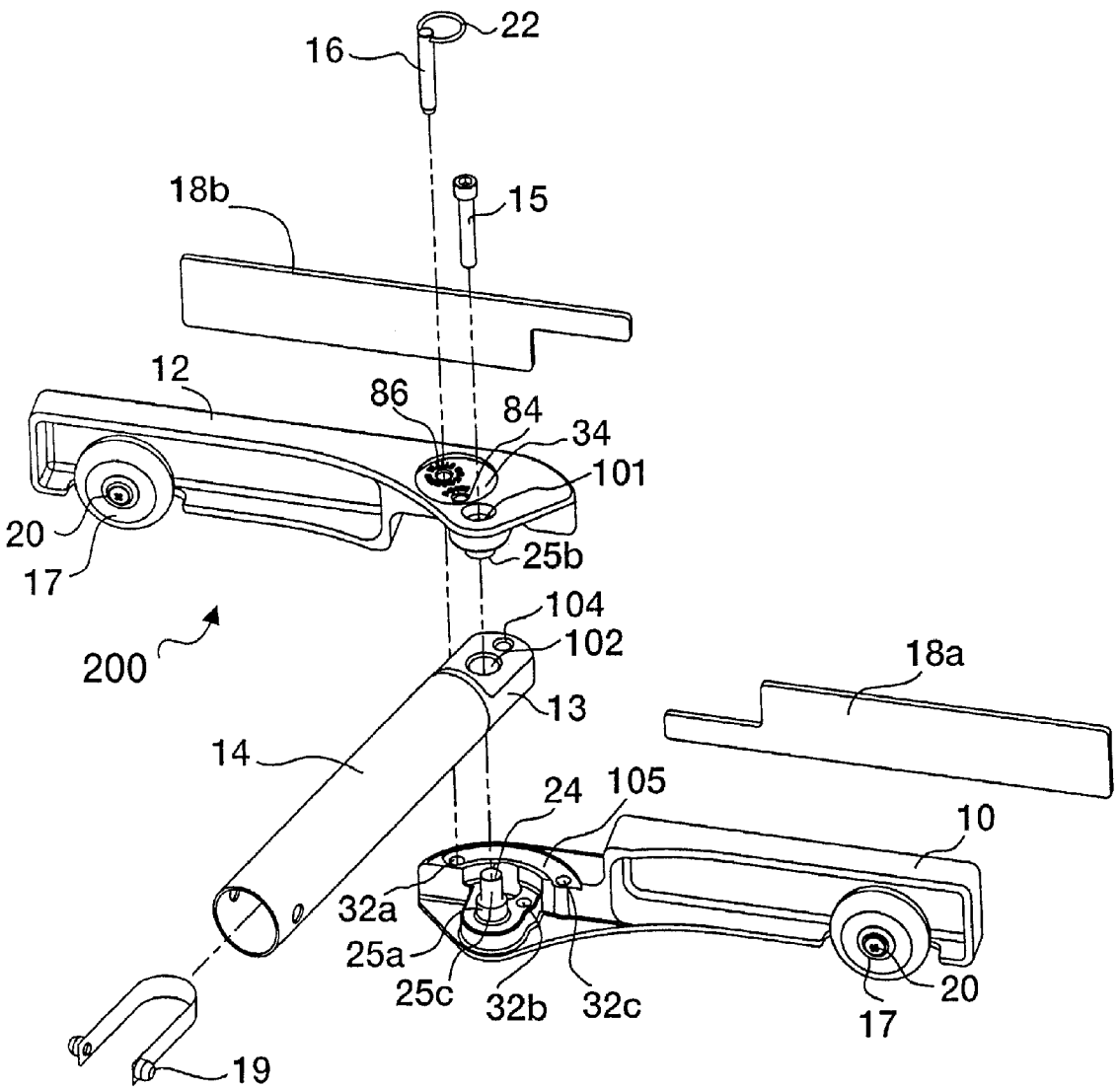
FIG. 5 is an exploded view of the tail section of FIG. 2.

With reference to FIGS. 2 and 3, tail section 200 includes bottom leg 10 and top leg 12, which are pivotably mounted to tube section 14. At one end of tube section 14 is a spring clip 19. This spring clip may be used to attach the end of tube section 14 to the tube section that forms the elongate body of the stretcher tool, such as was illustrated in FIG. 1. Connected to the opposite end of tube section 14 is pivot adapter 13. As shown in FIG. 5, socket cap screw 15 pivotably connects top leg 12, pivot adapter 13, and bottom leg 10. Socket cap screw 15 passes through holes 101, 102, and is screwed into or otherwise attached in hole 24.

As shown in FIG. 5, pin 16 extends through a first hole 86 in well 34 on upper leg 12, and into first hole 32*a* on lower leg 10. Well 34 ensures that pin 16 and ring 22 are recessed in a protected area. The user in certain situations may turn the tail section on its opposite side with the wheels 17 facing up, especially when it is desired that the tail block stay in place. In such instances the pin 16 does not project above the top surface of the top of leg 12 and thus prevent it from resting flat on the floor. When lower leg 10 and upper leg 12 are in a flat orientation with respect to their wall running surfaces, pin 16 extends into first hole 32*a* and holds lower leg 10 and upper leg 12 in this flat position.

First hole 86 on the top of leg 12 may be marked with the raised lettering "WALLS OR CORNERS" on the top surface of upper leg 12. When pin 16 is engaged in first hole 86 in top leg 12 and first hole 32*a* on lower leg 10, lower leg 10 and upper leg 12 are oriented such that the back, wall running faces of these legs form a substantially flat surface that may be braced against a straight, flat wall surface. As will be explained later, first hole 86 will be used for securing the legs either to form said substantially flat surface, or an angled surface (such as a 90 degree angle for corners), where said flatness or angled surface is measured by the included angle formed by the back, wall running faces of the tool. For the purpose of this tool, and as used herein, a "flat" surface shall be defined and measured as a configuration of a first leg and a second leg where the angle formed by the back, wall running surfaces of said legs is approximately 180 degrees. Said flat surface is illustrated in FIG. 3, where angle theta formed by the back, wall running surfaces of said first bottom leg 10 and said second top leg 12 approximately form an 180 degree angle. For the purpose of this tool, and as used herein, a "substantially flat surface" means conforming to the flatness tolerances found in commercially available carpet stretcher tail sections. In practice, a surface within a few degrees of flat (less than 10 degrees) could be used with thicker protector pad surfaces to conform with flat wall surfaces even though the included angle formed by the back, wall running surfaces of said first and second legs might deviate from flat by as much as 9 degrees. Thus, a substantially flat surface shall mean any included angle between 171 and 189 degrees. As used herein, "angled" shall mean any included angle formed by the back, wall running faces of a first and second leg which deviates from flat by ten degrees or more, which would include the range of all angles from zero to 170 degrees, and the range of 190 to 360 degrees. "Angled" shall include, without limitation, an included angle of approximately 90 degrees, as illustrated by angle alpha in FIG. 4. Now returning to the description of the hole 86, as shown in FIG. 5, when the pin 16 is in this hole 86, tube 14 will still pivot, as is required when stretching off walls or outside corners. For these reasons, first hole 86 may be marked "WALLS OR CORNERS".

As shown on FIG. 2, on pin 16 a ring 22 provides a means for gripping and extracting pin 16. Protector pads 18*a*, 18*b*, are secured to the wall running surfaces of lower leg 10 and upper leg 12, respectively. The pads may have vertical or horizontal ribs, raised dots or other surface structure if desired. Such a surface structure may be designed to reduce slippage along a wall or to cushion and distribute force when the stretcher applies pressure to the tail section.

In FIG. 3, a wheel 17 mounted on hub 20 is attached to both upper leg 12 and lower leg 10. This wheel allows the tail section to be rolled along the length of the wall to various locations where the carpet is stretched and secured.

Figure 4:
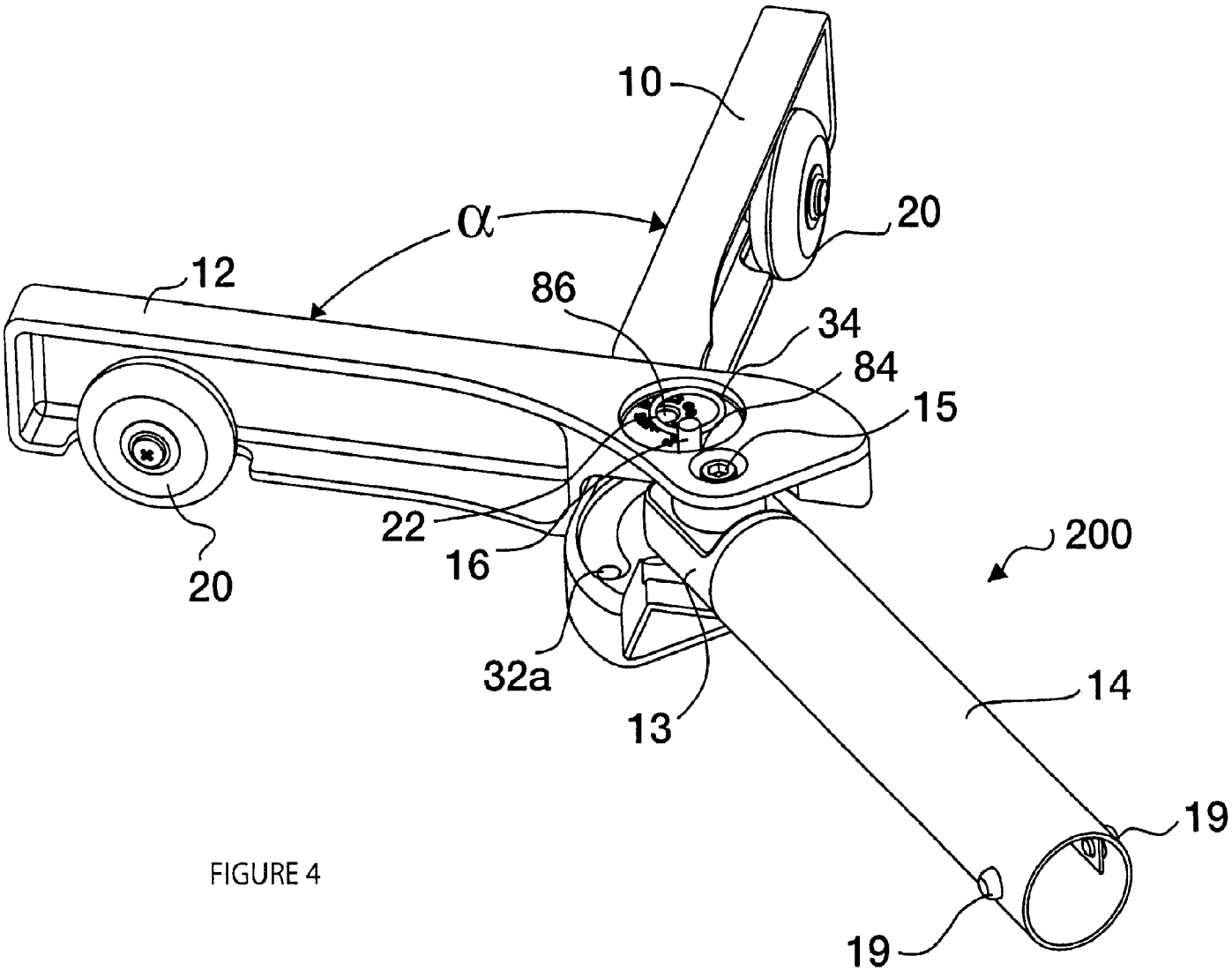
FIG. 4 is a front perspective of the tail section of FIG. 2 with the legs positioned at 90 degree angles with respect to their wall running faces.

With respect to FIG. 4, lower leg 10 and upper leg 12 are shown mounted to tube section 14. A spring clip 19 has two spring biased projections that can attach a second tube section to tube section 14. The biased spring projections of spring clip 19 will readily insert themselves into holes which may be in the tube of a power stretcher, or holes in the one of any number of extension tubes which may be attached to the tube of a power stretcher. As used herein, the word "elongate tube section" shall be defined as either the tube which is part of a carpet stretcher itself, or any number of extension tubes which may be attached to a carpet stretcher. More generally, an "elongate body" may be defined as any projection of the carpet stretcher itself, or any attachment to the carpet stretcher which may be meant to extend the length of the tool between the head and tail sections. Means other than tubes may be employed to provide an elongate or extendable body on a carpet stretcher, such as, without limitation, elongate solid steel bars. Attached to the opposite end of tube section 14 is a pivot adapter 13, which is pivotably mounted to bottom leg 10 and top leg 12 by socket cap screw 15. When connected to an elongate tube section, tail section 200 will remain parallel to the floor when in use, and not spin or come off the elongate tube section, due to the fact that the buttons on spring clip 19 prevent it from rotating or escaping. As shown in FIG. 5, the pivot formed by holes 101, 102, and 24 (on top leg 12, pivot adaptor 13, and bottom leg 10, respectively) and socket head cap screw 15, allows the angle that the tubes form with the wall to be variable as necessary.

In the configuration shown in FIG. 4, the lower leg 10 and the upper leg 12 have been positioned such that the back, wall running faces are oriented at an angle $\alpha$. For standard corners, this angle will be 90 degrees. If the user wishes to change the angle from an essentially flat angle of FIG. 2, to the 90 degree angle of FIG. 4, then, with reference to FIG. 4, pin 16 must be removed from first hole 86 in recessed well 34 of top leg 12, legs 10 and 12 must be adjusted to the desired 90 degree angle, and pin 16 must be replaced into either first hole 86 or second hole 84 in recessed well 34.

As previously mentioned, as shown in FIG. 5, first hole 86 may be marked "WALLS OR CORNERS". This marking may be a stamped imprint, painted on, a sticker, or any other marking. As shown in FIG. 5, if the user selects first hole 86, while lower leg 10 and upper leg 12 are at a 90 degree angle (with respect to the angle formed by their back, wall running faces), pin 16 will extend into hole 32*c* in lower leg 10. Pin 16 will then hold lower leg 10 and upper leg 12 at said 90 degree angle. Thus, tail section 200 will hold securely against a corner, preferably an outside corner in a room area. The tube will also pivot, as is preferred when stretching off an outside corner.

However, when stretching off posts, said 90 degree angle between the back, wall running faces of lower leg 10 and upper leg 12 is used and tube 14 should not pivot. Second hole 84 in well 34 of top leg 12 is provided for this purpose. It is possible that this second hole 84 could be marked in addition to or instead of first hole 86. This hole could be marked "POST" or "FIXED." This marking could be made in a manner similar to the above marking method. The user may put pin 16 in second hole 84.

As shown in FIG. 5, tube section 14 may be pivoted such that a hole 104 in pivot adapter 13 is in line with second hole 84, and pin 16 may be further extended through hole 104. Pin 16 further extends into a hole 32*b* in bottom leg 10. Thus top leg 12 and tube 14 are both locked into bottom leg 10 by pin 16. Bottom leg 10 and top leg 12 are locked at said 90 degree angle (with respect to their back, wall running faces), and pivot adapter 13 and tube 14 will not pivot but are locked in place in relation to legs 10, 12. As shown in FIG. 4, this is the illustrated configuration for use of the tail section 200 stretching carpet using a post in the middle of a room for a support. The 90 degree angle of the back, wall running faces will brace and hold against a curved surface, as is commonly encountered at a post. The tubes will not pivot, so that the tail section 200 will be able to rotate 360 degrees around the post as the elongate tube section is moved. At any point, tail section 200 may be braced against the post without slipping.

In FIG. 5, the exploded view of the device shows the tube section 14 having an inserted spring clip 19 at a first end of tube 14, allowing attachment to an elongate tube section. For installation in a large room, a plurality of such elongate tube sections would be joined together on tail section 200, and on the opposite end the power stretcher is attached. One would be attached to tail section 200 at said first end by means of spring clip 19, and the others joined end-to-end. At the second end of tube section 14 is pivot adapter 13. Extending into hole 102 is projection 25*b* on upper leg 12 and projection 25*a* on lower leg 10. Press fit into a hole in projection 25*a* is a steel tube 25*c*. Steel tube 25*c* fits into a hole in the bottom of projection 25*b*. Socket head cap screw 15 runs through steel tube 25*c* and is fastened into a tapped hole below the depth of steel tube 25*c*. As bottom leg 10 and top leg 12 may be aluminum castings, steel tube 25*c* is necessary to reinforce the holes in the castings and resist pivot wear from socket cap screw 15, and to precisely space lower leg 10 and upper leg 12 so they do not rub together and jam. Cap screw 15 has a head retained within counterbored hole 101 in the top face of top leg 12. Cap screw 15 is screwed into threads in hole 24 in projection 25*a*. Pivot adapter 14 may rotate on projections 25*a*, 25*b*. A radial boss (not visible) on the bottom of top leg 12 inserts into radial raceway 105 on the top of bottom leg 10 to reinforce the pivot and keep bottom leg 10 and top leg 12 always extending or contracting in a radial manner limited by the ends of said radial boss and radial raceway 105.

Lower leg 10 and upper leg 12 are each shown having an attachable protector pads 18*a* and 18*b* which may be secured (as by adhesive) to a back wall running face of legs 10, 12. In addition, each of legs 10, 12 have a wheel 17 mounted on an axle 20 to allow the tail section to be rolled along a wall.

On top of upper leg 12 is a recessed well 34 having a hole 86. When upper leg 12 and lower leg 10 are positioned to form a substantially flat surface, pin 16 is inserted into a first hole 86 on upper leg 12 and in a first hole 32*a* of bottom leg 10 to lock upper leg 12 and lower leg 10 so that the overall wall running surface of tail section 200 is substantially flat. This allows for use on straight, flat walls. The tail section may be rolled along straight flat walls using wheels 17. When the user needs to reposition the tool for stretching a new carpet area, the user can simply disengage the head of the tool from the carpet by lifting it using the handle of the tool and kicking the elongate tube section with the side of the user's leg. The elongate tube section is easily moved by the rolling action of wheels 17 of the tail section 200.

At an outside corner surface of two walls, the lower leg 10 and upper leg 12 can be repositioned such that the wall running faces are at right angles to each other. The pin 16 is inserted into a first hole 86 in well 34 in the top face of upper leg 12 and will extend into a second hole 32*c* of lower leg 10. Pin 16 will then hold upper leg 12 and lower leg 10 at a 90 degree angle such that tail section 200 can be fit securely against the outside corner without slipping. If it is desired to stretch off a post, the user may insert pin 16 in a second hole 84 in well 34 of the top face of upper leg 12, through a hole 104 in pivot adapter 13, and into a third hole 32*b* in bottom leg 10. When the pin is inserted through these three holes, bottom leg 10 and upper leg 12 are locked at a 90 degree angle, and pivot adapter 13 and tube 14 will not pivot, as is useful for stretching off posts. Hole 104 in the pivot adapter 13 and hole 84 in the top leg allow locking of the leg in position with respect to tube 14. Hole 86 is a pivot enabling hole that does not align with hole 104 in pivot adapter 13.

A number of alternatives may be adopted to create a tail section with a first and second leg, in which said legs may be repositioned to produce various preferred angles with respect to the back, wall running faces of said legs. As shown in FIG. 7, one alternative might employ separate wells and holes for each preferred position. Well 80 has hole 107 (shown with pin 16 extending into this hole) for the flat position. Well 34 has a hole 108 for locking the legs at a 90 degree angle in relation to their wall running faces, while also locking pivot adapter 13 and tube 14. Well 82 has a hole 84 for locking the legs at a 90 degree angle in relation to their wall running faces, but does not lock pivot adapter 13 or tube 14. A pin 16 may be inserted in said holes. Said wells and holes may be located in either the top or bottom legs.

Figure 9:
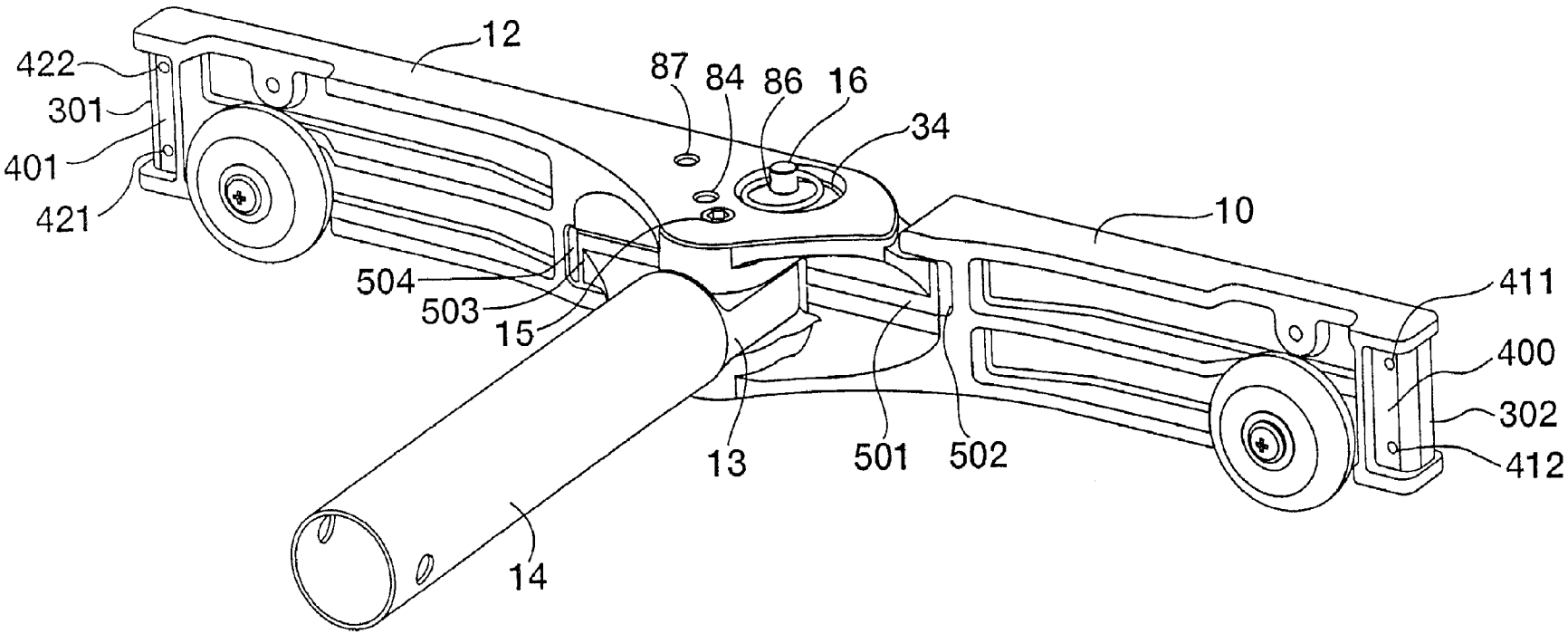
FIG. 9 is a front perspective view of an alternative embodiment of a tail section.

As shown in FIG. 9, a hole 86 and well 34 may be placed behind socket head cap screw 15. In this embodiment, pin 16 may be inserted into hole 86 for locking lower leg 10 and upper leg 12 in a substantially flat position with respect to their back, wall running faces. This embodiment is preferred for bearing maximum load in a substantially flat position. Placing hole 86 behind socket head cap screw 15 and at roughly the midway point between left end 301 and right end 302 equalizes the shear force that upper leg 10 and lower leg 12 may have on pin 16, and equalizes the force that the holes in lower leg 10 and upper leg 12 must handle. Any off center location of hole 86 gives one or the other leg more leverage, placing greater force in the hole on the opposite leg. This increases the likelihood of breaking a leg or bending a pin 16, especially when there is no wall support except at ends 301, 302. (Such may occur whenever the back, wall running faces of lower leg 10 and upper leg 12 are not braced against a uniformly flat surface and fully supported all the way to ends 301, 302. In such cases, ends 301, 302 may generate a great deal of leverage and shear force on pin 16.) Alternatively, pin 16 may be inserted in hole 84 for locking upper leg 10 and lower leg 12 at a 90 degree angle with respect to their back, wall running faces, while also locking pivot adapter 13 and tube 14. Pin 16 may be inserted in hole 87 for locking upper leg 10 and lower leg 12 at a 90 degree angle with respect to their back, wall running faces, but in this position pivot adapter 13 and tube 14 may pivot freely. Holes 84, 87 may not have wells to give this section of upper leg 12 maximum thickness and maximum strength.

As further shown in FIG. 9, left end 301 on upper leg 12 may have recess 401 and holes 421, 422, and right end 302 may have similar recess 400 with holes 411, 412. These recesses and holes enable a wall protector pad (such as 18*a*, 18*b* in FIG. 5) to be wrapped around end 301 of upper leg 12, or end 302 of lower leg 10, and fastened in any of holes 411, 412, 421, 422 with fasteners. The wrapped edge would keep ends 301, 302 from scuffing a wall surface. Furthermore, upper leg 12 may have leg extender 501, which may fit into a socket 502 in lower leg 10, and lower leg 10 may have a similar corresponding extender 503 which may fit in a socket 504 in upper leg 12. These leg extenders and sockets may interlock and brace upper leg 12 and lower leg 10 against one another and thus eliminate all shear force on pin 16 when pin 16 is inserted in hole 86. Such is useful to prevent pin 16 from bending when upper leg 12 and lower leg 10 are in a flat position, which is when they generate the greatest leverage and shear force on pin 16.

As further shown in FIG. 9, upper leg 10 and lower leg 12 may be mirror images of each other, but designed to interlock. This would increase manufacturing efficiency. The parts would be identical and could run faster in a multi-cavity die casting process.

Figure 11:
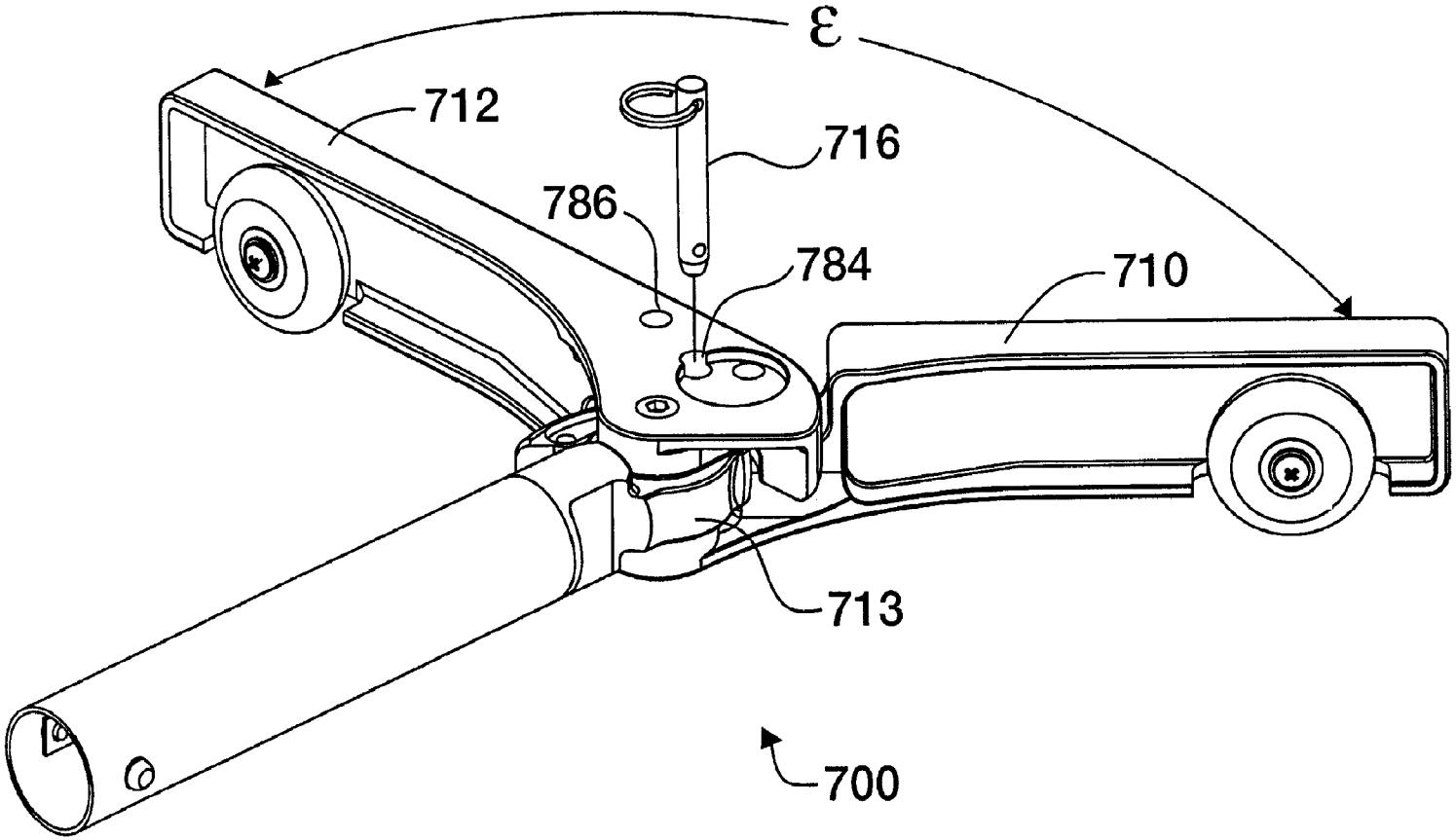
FIG. 11 is a front perspective view of an alternative embodiment of a tail section.

In another alternative, as shown in FIG. 11, an additional angle epsilon of approximately 135 degrees between the back, wall running surfaces of a lower leg 710 and an upper leg 712 may be provided specifically for stretching off posts. The wider angle allows tail section 700 to be used against larger posts. Hole 784 in upper leg 712 in combination with a hole or notch in pivot adapter 713 and a hole in lower leg 710 may lock upper leg 712 and lower leg 710 at the desired 135 degree angle, while also locking pivot adapter 713. Alternatively, hole 786 may lock only upper leg 712 and lower leg 710 at the desired 135 degree angles, while still allowing pivot adapter 713 to pivot. As posts become larger, they behave more like flat walls, and it becomes preferable that pivot adapter 713 may pivot.

In another alternative, the tail section may have one or two holes and pins may be provided for locking the legs at a flat or 90 degree angle, with an entirely separate hole and pin dedicated to the purpose of locking the pivot tube.

In another alternative, the tail section may have additional wells, holes, and pins dedicated to the purposes of locking the legs in any number of additional angles in addition to flat and 90 degrees. In such an alternative, locking for the pivot tube could be accomplished by one of the holes provided for locking the legs at a given angle, or by a separate well, hole, and pin dedicated to this purpose.

In any of the aforementioned embodiments, rather than using pins to lock the legs or the pivot tube, threaded bolts and nuts may be used. Alternatively, ball and socket joints may be used. All these means of locking the bottom leg and top leg and/or the tube are considered alternatives that could be adopted.

FIG. 6 illustrates an alternative for angle formation of the legs in which, in any top face of bottom leg 10 (such as the top face of projection 25*a*) or in any bottom face of top leg 12 (such as bottom face of projection 25*b*), a pattern of corresponding ridges and valleys may be formed in surfaces 96 and 94 respectively. Said ridges and valleys may be formed into projections 25*a* and 25*b* (FIG. 5) of bottom leg 10 and top leg 12 at any number of angles. Alternatively, a pall and ratchet system may be employed to lock the bottom and upper legs.

Figure 8:
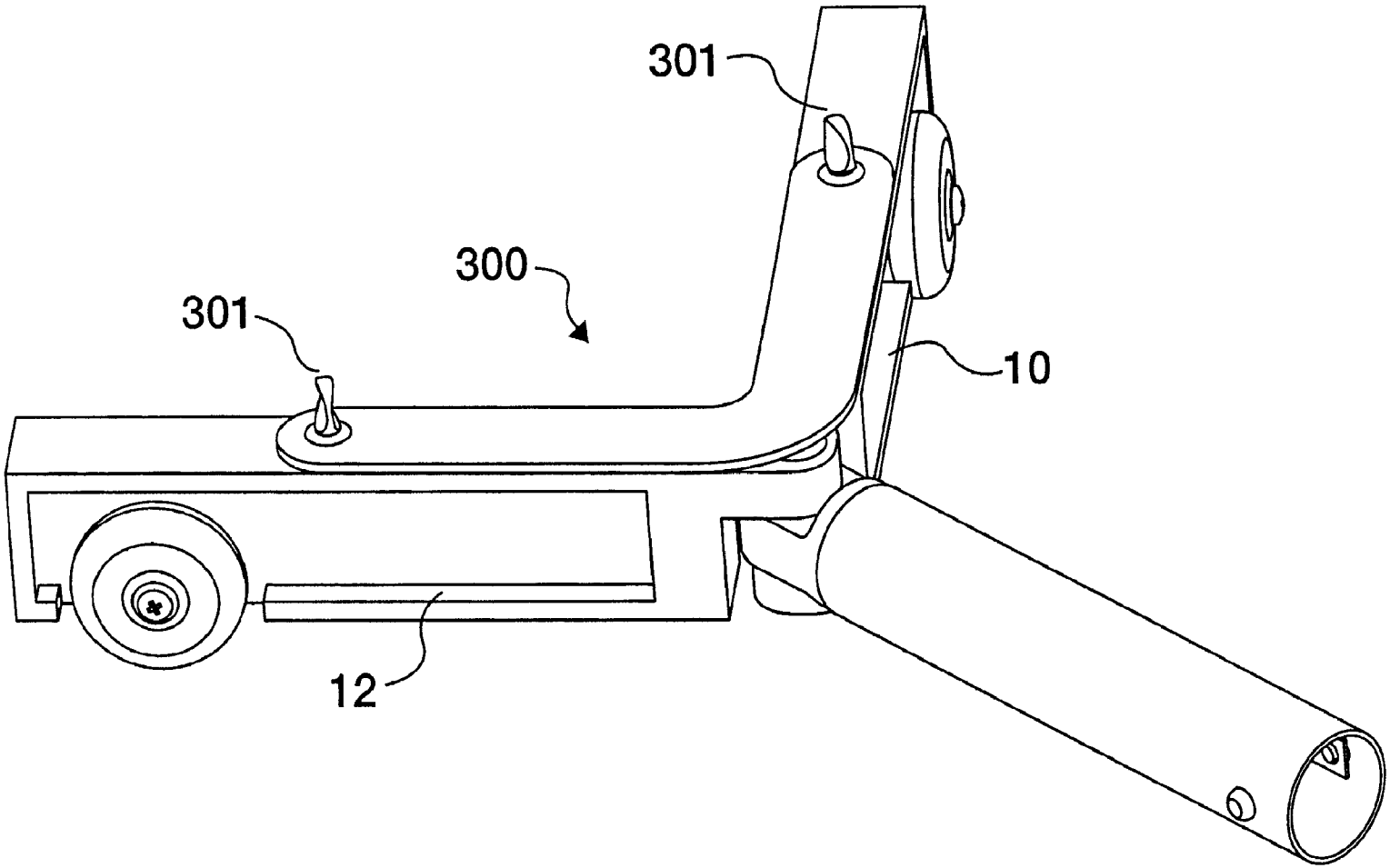
FIG. 8 is a front perspective view of a tail section including an alternative embodiment for angle formation and locking of the top and bottom legs that employs an arm which may be fastened to surfaces on said top and bottom legs.

As shown in FIG. 8, an arm 300 may be affixed as by thumbscrews 301 to either or both first leg 10 and second leg 12. Said arm may have a series of holes for pins, nuts, or bolts, which might be further inserted or fastened into either or both first and/or second leg. With this alternative, unless first or second leg was inherently fixed in position, two separate pins and/or threaded nuts and bolts would be required to create the necessary stops.

In addition to a first and second leg which may pivot, the lock for the tube section, which is necessary for stretching off posts, may be accomplished with several alternatives. Rather than extending through a separate pivot adapter, a locking pin may be extended through the tube itself. A series of ridges and valleys might also be cast into the pivot adapter and the first and second legs. A ball and socket or dog and ratchet system might also be used.

As shown in FIG. 5, holes 84 and 86 in top leg 12, hole 104 in pivot adapter 13, and holes 32*a*, 32*b*, and 32*c* in bottom leg 10 are all circular holes designed to accept circular pin 16. However, these holes may ovular or semicircular notches, rather than continuous round holes. Rectangular or other shape holes or notches may also be employed with a pin of corresponding shape. Any such pin receiving structure would allow a locking of a leg.

Figure 10:
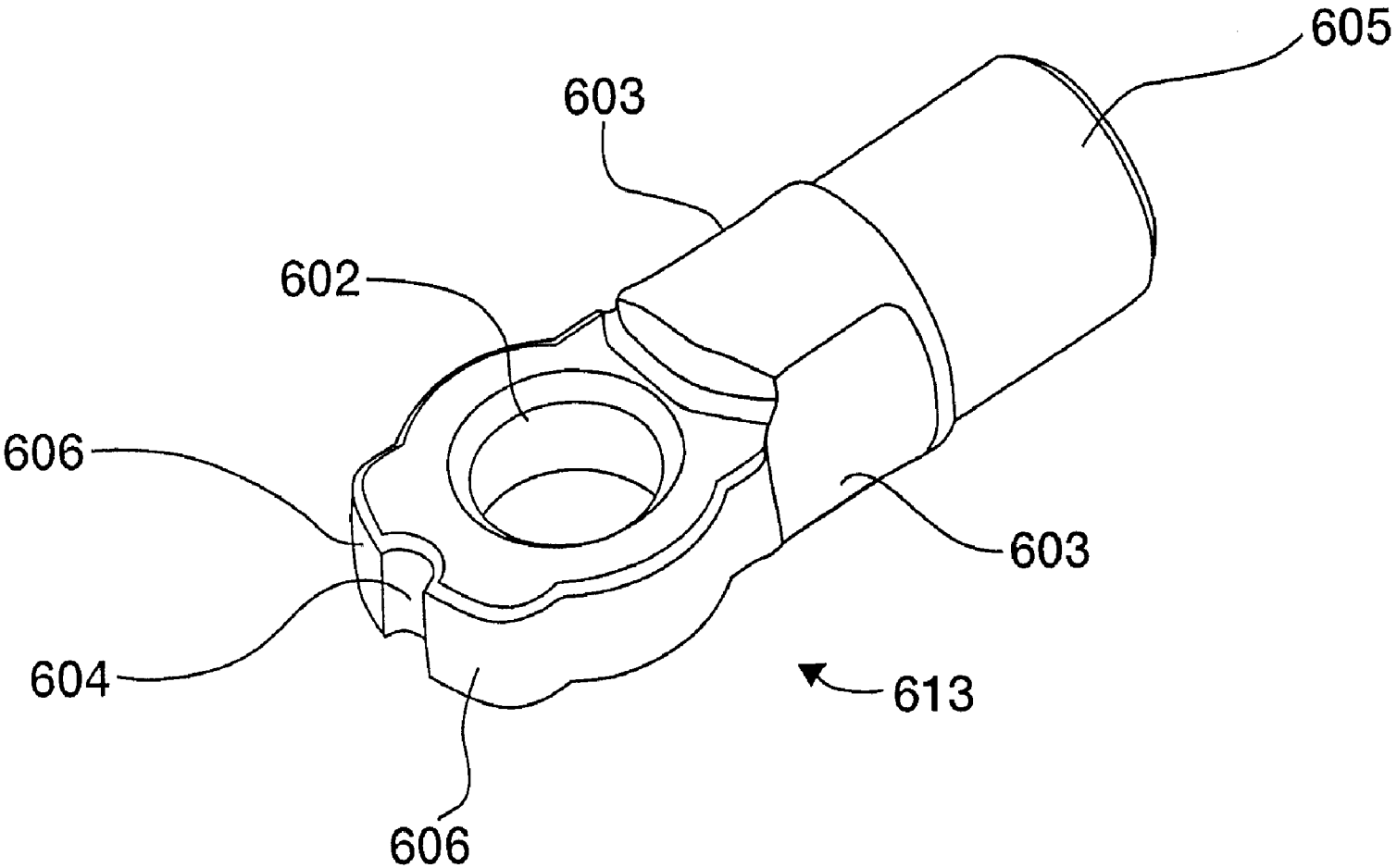
FIG. 10 is a front perspective view of an alternative embodiment of the pivot adapter.

FIG. 10 in particular shows an alternative embodiment of the pivot adapter 13 of FIG. 5 with non-circular holes. The alternative pivot adapter 613 of FIG. 10 has non-circular holes and a notch. The pivot hole 602 is oval-shaped so that under load the adapter will slide on projections 25*a* and 25*b* (FIG. 5) and contact the inner wall of top leg 10 and lower leg 12 (FIG. 5), thus reducing shear force on projections 25*a* and

25*b*. As shown in FIG. 10, semicircular notch 604 defined in relation to surfaces 606 provides a space for pin 16 when it is desired to lock pivot adapter 600, such as when stretching off posts. Faceted sides 603 on either side of the adapter may prevent pivot adapter 600 from contacting top leg 12 or lower leg 10 (FIG. 5) when stretching at extreme angles. End 605 is round to accept press fit of a tube such as tube 14 (FIG. 5).

The present illustrated embodiments can be characterized in a number of different ways. First, the device could be sold as a complete carpet stretcher tool, as shown in FIG. 1, having an improved tail section illustrated in any of the remaining Figures or set out in this detailed description. Alternatively, the tool could be sold disassembled in a carrying case. The elements would remain the same, but the tool would require assembly by the user prior to commencing use of the tool.

A third alternative is that just the tail section could be sold separately. This could be sold as a part that includes a tube section, a wall running section, and an adapter if included. Alternatively a wall running section, such as the two legs illustrated in FIGS. 2-5 could be sold as the tail section alone. These elements could be sold to mount on an existing adapter or tube section.

One of the illustrated embodiments is a tail section having a wall running section comprised of a first and second leg that are angularly adjustable with respect to each other. This allows the tool to be used along straight, flat wall sections, at outside corners of an "L" shaped room, or in rooms where there may be a freestanding post in the center of the room. If said post is round, the angled face created by the two back faces of the first and second legs may follow all around the 360 degree contour of the post, providing a brace for the stretcher at any point. If said post is angled, for example as a square post, the tool can be braced against any corner on said square post, and the tool can be used in the same manner as it would be used at an outside corner in an "IL" shaped room.

Another embodiment of the tail section includes a tube, an adapter mounted in the tube and a wall running section. The wall running section could be the section shown in the FIG. 1 prior art carpet stretcher (where said prior art wall running section is one part), or it may be the wall running section of FIGS. 2-5, 7, 8, 9, or 11 consisting of two legs (two parts), or even the tail sections illustrated in the references discussed in the background section. These references are hereby expressly incorporated by reference (for all purposes). The adapter allows the wall running section to be attached such that the wall running section can pivot in one configuration and be prevented from pivoting in a second configuration. The use of the adapter, rather than direct mounting on the tube section as has been previously taught, does add an extra element but significantly enhances the durability of the parts and avoids wear on the tube section.

What is claimed is:

1. A tail section for a carpet stretching tool, the tail section comprising:

a tube section made of at least a first material;

a pivot adapter mounted on said tube section and made of at least a second material differing from the first material; and a wall running section mounted on said pivot adapter, said wall running section being mounted such that in a first configuration the wall running section may pivot and in a second configuration said wall running section is held in a fixed position relative to said tube section and is not able to pivot.

2. The tail section of claim 1, further including a pin, wherein said pin may fit into a pin receiving structure on said wall running section and into a pin receiving structure on said pivot adapter.

3. A tail section for a carpet stretching tool, the tail section comprising:

a tube section made of at least a first material;

a pivot adapter mounted on said tube section and made of at least a second material differing from the first material;

a wall running section mounted on said pivot adapter such that said wall running section may pivot; and a pin that, when inserted into a first pin receiving structure on said pivot adapter and a second pin receiving structure on said wall running section, prevents said wall running section from pivoting.

4. The tail section of claim 3, wherein the first material is steel and the second material is aluminum.

5. The tail section of claim 3, wherein said wall running section includes a pivot enabling pin receiving structure configured such that the pin could be inserted into the pivot enabling pin receiving structure and would not engage the pivot adapter, and thus would not prevent said wall running section from pivoting.

6. The tail section of claim 3, wherein said wall running section includes a first leg and a second leg, said legs attached to said pivot adapter such that the legs can move in an arc with relation to each other.

* * * * *